United States Patent [19]

Ullmann

[11] Patent Number: 4,669,189

[45] Date of Patent: Jun. 2, 1987

[54] HAIR CUTTING APPARATUS, IN PARTICULAR ELECTRIC HAIR CUTTING APPARATUS

[75] Inventor: Roland Ullmann, Offenbach am Main, Fed. Rep. of Germany

[73] Assignee: Braun Aktiengesellschaft, Kronberg, Fed. Rep. of Germany

[21] Appl. No.: 889,991

[22] Filed: Jul. 28, 1986

[30] Foreign Application Priority Data

Aug. 17, 1986 [DE] Fed. Rep. of Germany ..... 3529516

[51] Int. Cl.[4] ..... B26B 19/20

[52] U.S. Cl. ..... 30/201; 30/196; 30/200; 30/233

[58] Field of Search ..... 30/216, 210, 201, 220, 30/219, 196, 241, 195, 233

[56] References Cited

FOREIGN PATENT DOCUMENTS 3441060 6/1985 Fed. Rep. of Germany .
4162881 9/1981 Japan .
3918083 9/1983 Japan .

*Primary Examiner*—E. R. Kazenske
*Assistant Examiner*—Willmon Fridie, Jr.
*Attorney, Agent, or Firm*—Raymond J. De Vellis

[57] ABSTRACT

In a hair cutting apparatus, particularly an electric hair cutting apparatus, with a shearing head comprised of a shear plate and a cutting element as well as with a spacer comb adapted to be seated on the shearing head for sliding contact with the skin surface to be treated, with the position of the forward edge of the cutting element being adjustable relative to the skin surface, the spacer comb (3)—upon being seated on the shearing head (2) of the hair cutting apparatus (1)—is adapted to be coupled with the hair cutting apparatus by centrally controlled coupling members (10, 14, 23) cooperating with coupling members (16, 18, 24) of the comb to provide a coupling (13) between the body (7) of the hair cutting apparatus (1) and the spacer comb (3), the coupling members being adapted to move the said spacer comb into its individual ratchet positions producing different lengths of the cut. The coupling members (10, 14, 23) providing for coupling and uncoupling of the spacer comb 3 are controlled by a slide control (11) of the body (7) of the hair cutting apparatus (1) in which all functions of the hair cutting apparatus including enabling and disabling of the drive are incorporated.

14 Claims, 17 Drawing Figures

HAIR CUTTING APPARATUS, IN PARTICULAR ELECTRIC HAIR CUTTING APPARATUS

BACKGROUND OF THE INVENTION

This invention relates to a hair cutting apparatus, in particular an electric hair cutting apparatus, with a shearing head comprised of a shear plate and a cutting element, with a spacer comb adapted to be seated on the shearing head for sliding contact with the skin surface to be treated, with the position of the forward edge of the cutting element being adjustable relative to the skin surface, and with a slide control for enabling and disabling the drive of the hair cutting apparatus.

In the use of hair cutting apparatus of this type, the accompanying spacer comb mounts simply by being slipped on the shearing head of the apparatus by hand. The spacer comb thus seated on the shearing head of the hair cutting apparatus is secured thereto according to the requirements of its use by means of a detent spring cooperating with a detent nose on the shearing head. However, in order to cut the hair to different lengths, it is absolutely necessary for the spacer comb to be positioned at different distances from the forward or cutting edge of the shearing head comprising a shear plate formed fast with the apparatus and an oscillating cutting element cooperating therewith. In known hair cutting apparatus, including to some extent also commercially available hair cutters, this possibility of locking the spacer comb in positions relating to the distance between the plane of its tooth-shaped supports sliding over the skin surface to be treated and the forward or cutting edge of the shearing head or the associated cutting element of the hair cutting apparatus is afforded by parallel ratchet bars formed at the outer side or sides of the shearing head housing which cooperate with lever-type detent members provided on or in the side walls of the spacer comb to operate as a ratchet gear. While such hair cutting apparatus do allow an axial displacement of the spacer comb seated on the shearing head for the purpose of varying its ratchet position in accordance with the desired length of the hair cut, it is to be considered also that such a ratchet gear on the outer wall of the body of the hair cutting apparatus, being always gripped by the user's hand, is subject to substantial wear resulting particularly from the fact that, as the spacer comb is slipped on the shearing head, at least one but mostly several or all of the outwardly projecting tight ratchet knobs are overtraveled by the inwardly projecting detent members of the spacer comb and are frictionally engaged by them in the process. The knobs on the shearing head housing are worn off or abraded by the sharp edges of the teeth of these detent members already after a relatively short period of use, so that accurate positioning of the spacer comb on the shearing head is no longer possible.

Fixing the spacer comb in place on the shearing head of the hair cutting apparatus in this manner incurs another shortcoming, that is, in order to vary the length of the cut it is necessary for the spacer comb to be gripped by two fingers, spread apart, of the hand not holding the hair cutting apparatus, and to be subsequently displaced relative to the casing of the apparatus in the slip-on or slip-off direction—depending on the desired length of the cut—until its detent member engages into the respective notch on the casing which corresponds to the selected ratchet position. This operation requires the user to abandon the position of use of the hair cutting apparatus and to seize it subsequently with his one hand to enable his other hand to adjust the spacer comb on the shearing head while keeping a close eye on the hair cutting apparatus and the spacer comb.

SUMMARY OF THE INVENTION

It is an object of this invention to provide a hair cutting apparatus of the type initially referred to which uses one single control for adjustment of the spacer comb to positions of use or ratchet positions which correspond to different lengths of the cut, for securing the spacer comb in its slipped-on condition on the hair cutting apparatus, and for enabling and disabling the electric drive of the hair cutter.

In the hair cutting apparatus of this invention, this object is accomplished by the invention providing the spacer comb and the slide control with engageable coupling means, providing further ratchet positions for the spacer comb in addition to the on and off positions of the slide control, and securing in the individual ratchet positions the engaged coupling means of the spacer comb and the slide control from becoming disengaged by means of an arrest.

This solution of the invention permits the operation of the hair cutting apparatus, that is, its turning on and off as well as the adjustment of the spacer comb to its individual ratchet positions by means of a single control. The awkward procedure of gripping the spacer comb on the shearing head for adjustment of the desired ratchet position is thereby avoided.

BRIEF DESCRIPTION OF THE DRAWINGS

The subject of the invention will be described in more detail in the following by way of an example encompassing several particular embodiments, reference being had to the accompanying drawings, in which.

DESCRIPTION OF THE PREFERENCE EMBODIMENT

Figure 1:
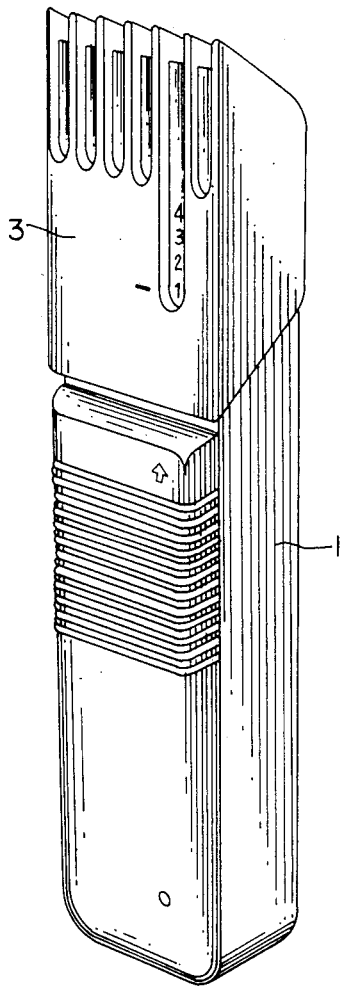
FIG. 1 is a perspective view of the hair cutting apparatus of the invention.
Figure 2:
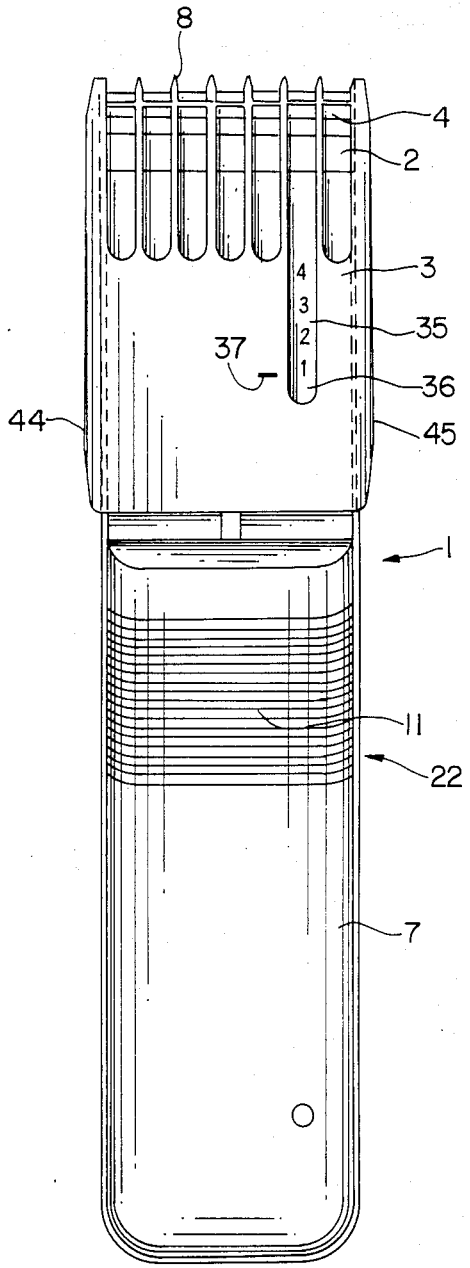
FIG. 2 is a front view of the hair cutting apparatus of the invention, showing the spacer comb in its seated position.
Figure 3:
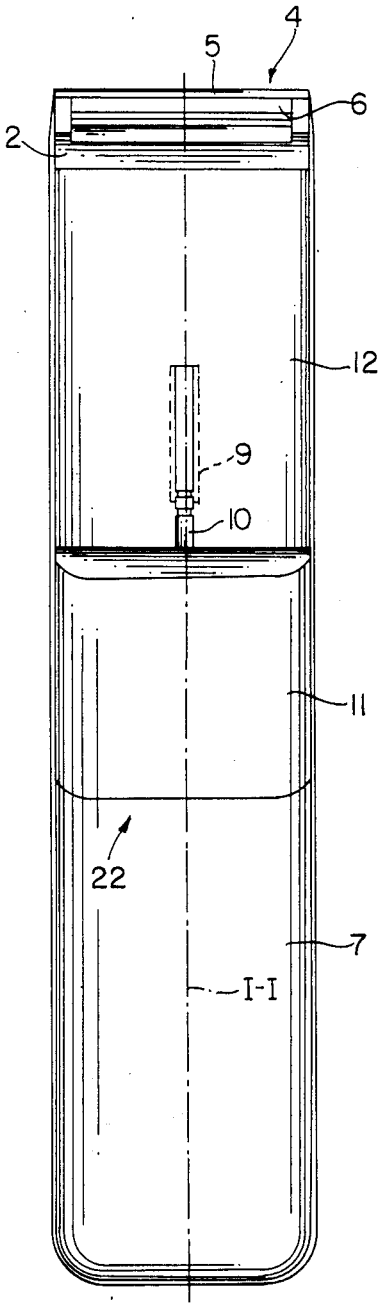
FIG. 3 is also a front view of the hair cutting apparatus of the invention, with the spacer comb removed.

As becomes apparent from FIGS. 1 to 4, the hair cutting apparatus 1 of the invention comprises substantially a slim, haptical body having a shearing head 2 obstructed in FIGS. 1 and 2 by a spacer comb 3 seated on the shearing head 2. The spacer comb 3 operates to maintain a predetermined distance of the forward edge 4 of the shearing head 2 comprised of a fixed shear plate 5 and a cutting element 6 reciprocating thereon relative to the skin surface to be treated, for example, the scalp of a person whose hair is to be cut, with the spacer comb being adjustable to different positions on the shearing head relative to the body 7 of the hair cutting apparatus 1, to be explained later as the description proceeds.

The spacer comb 3, being a hollow body, embraces the body 7 of the hair cutting apparatus 1 in the region of its shearing head 2 on all four sides, with tooth-shaped supports 8 formed at the comb enabling the hair to be cut to extend therebetween up to the shearing head 2 to be eventually cut off by its cutting element 6. The remaining length of the hair after the cut corresponds to the distance between the forward edge of the tooth-shaped supports 8 contacting the skin surface and the forward or cutting edge of the shearing head or its cutting element, this distance being variable in the present hair cutting apparatus, as already mentioned.

For an efficient use of the hair cutting apparatus by means of the spacer comb determining the length of the hair to be cut, the spacer comb includes coupling means cooperating with appropriate coupling members of the body[7] of the hair cutting apparatus.

Figure 4:
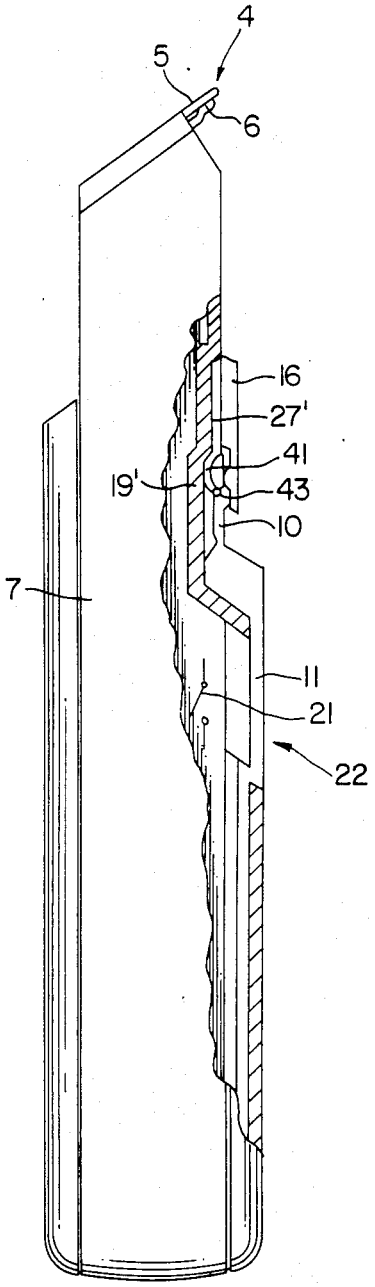
FIG. 4 is a side view of the hair cutting apparatus of FIG. 3, shown partially in longitudinal section taken along the line I—I of FIG. 3.
Figure 5:
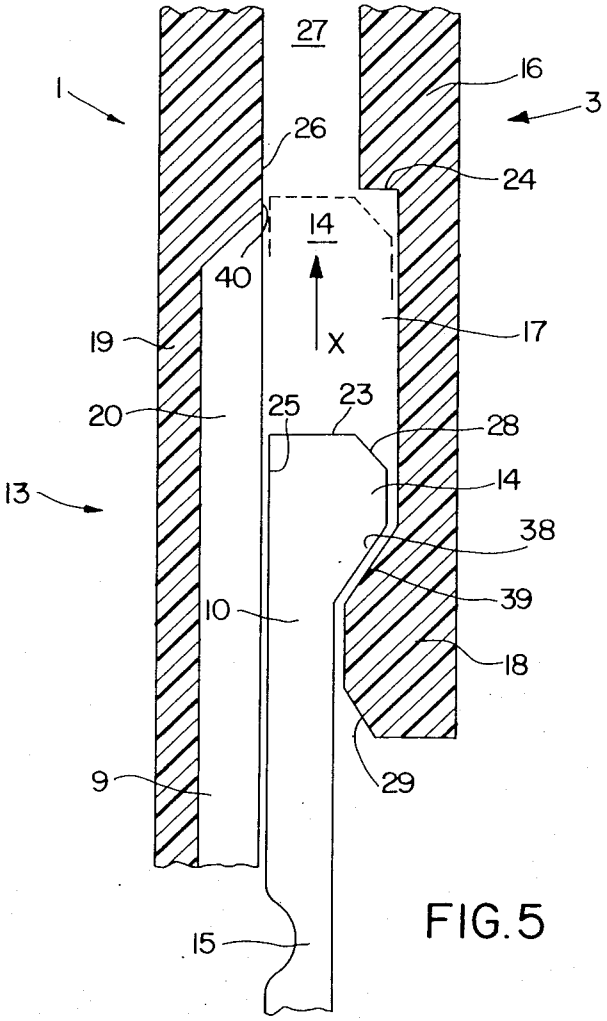
FIG. 5 is a schematic of the basic coupling structure between the hair cutting apparatus and the spacer comb seated on the shearing head.

As shown particularly in FIGS. 4 and 5, the hair cutting apparatus has for this purpose a coupling rod 10 which is slidable in the direction of the longitudinal axis x of the hair cutting apparatus 1 in a guideway 9 of T-shaped cross section provided in the casing. The coupling rod 10 is operatively connected with a slide control 11 extending over the entire width of the hair cutting apparatus 1, thereby permitting a safe operation of the device by the user's left or right hand, that is, a one-hand operation. The slide control 11 fulfils several functions, first it serves to enable or disable the electrical or mechanical drive of the hair cutting apparatus, then it provides for engagement or disengagement of the spacer comb 3 with or from the hair cutting apparatus according to the requirements of its use, and finally it functions to adjust the coupled spacer comb to its individual positions of use resulting in different distances.

FIGS. 5 to 10 show, in various phases of engagement, the function of the coupling rod 10 slidable in longitudinal direction by means of the slide control 11 within and below the front wall 12 of the hair cutting apparatus as it cooperates with the coupling means of the spacer comb 3.

In this arrangement, FIG. 5 shows the basic mode of operation of the coupling 13 between the slide control 11 of the hair cutting apparatus 1, which control is operatively connected with the coupling rod 10, and the spacer comb 3 adapted to be seated on the shearing head 2 of the body 7 of the hair cutting apparatus.

As shown, the coupling rod 10 operatively connected with the slide control 11 includes a coupling nose 14 which is pivoted about the axis of a film hinge 15 formed at the rod 10, such that the coupling nose 14, following each pivot movement, automatically returns to its initial position shown in FIG. 5.

In the region of its wall 16 serving as coupling means, the spacer comb 3 which embraces the shearing head 2 of the hair cutting apparatus 1 when seated thereon includes a coupling groove 17 receiving the rod 10 together with its coupling nose 14. The coupling groove 17 comprises a shoulder 18 which is formed at the coupling wall 16 of the spacer comb 3 and is overcome by the coupling nose 14 of the coupling rod 10 by their withdrawal into a recess 20 formed in the region of the coupling groove 17 by a wall 19 of the hair cutting apparatus 1 as the spacer comb 3 is being seated.

The seated spacer comb 3 is then retained by the coupling nose 14 of the rod 10 engaged behind the detent shoulder 18 of the comb and is thereby secured from inadvertent disengagement from the hair cutting apparatus. In this seated position of the coupling members 10, 14 of the hair cutting apparatus 1 and the coupling means 16, 17, 18 of the spacer comb 3 thus brought into relative engagement, the slide control which also operates on electric switching means 21 for the drive is still in its zero or off position in which the supply circuit of the hair cutting apparatus is open. By subsequent shifting of the slide control 11 and consequently also of the coupling rod 10 into the direction of the axis x of the hair cutting apparatus 1 —which corresponds to the direction of movement x of the spacer comb 3—from the "off" position shown in FIG. 5 to the "on" position shown in dotted lines, the slide control 11 will actuate the switching means 21, thereby closing the supply circuit of the hair cutting apparatus 1 and thus enabling its drive not shown.

In this "on" position, the end wall 23 of the coupling rod 10 abuts a shoulder 24 formed on the coupling wall 16 of the spacer comb 3, while the side wall 25 on the side remote from the coupling nose (according to FIG. 5) becomes slidably engaged by the outer wall 26 of a forced guide 27 formed by the casing wall 19 of the hair cutting apparatus 1 and the coupling wall 16 of the spacer comb 3. In the "on" position of the slide control 11, the forced guide 27 thus prevents the coupling rod 10 from yielding to the shoulder 24. Accordingly, the beveled edge 28 of the coupling rod 10 which, as the spacer comb 3 is being seated, cooperates with the beveled edge 29 of the detent shoulder 18 of the coupling wall 16 of the comb to facilitate yielding, has no effect in this position.

Figure 6:
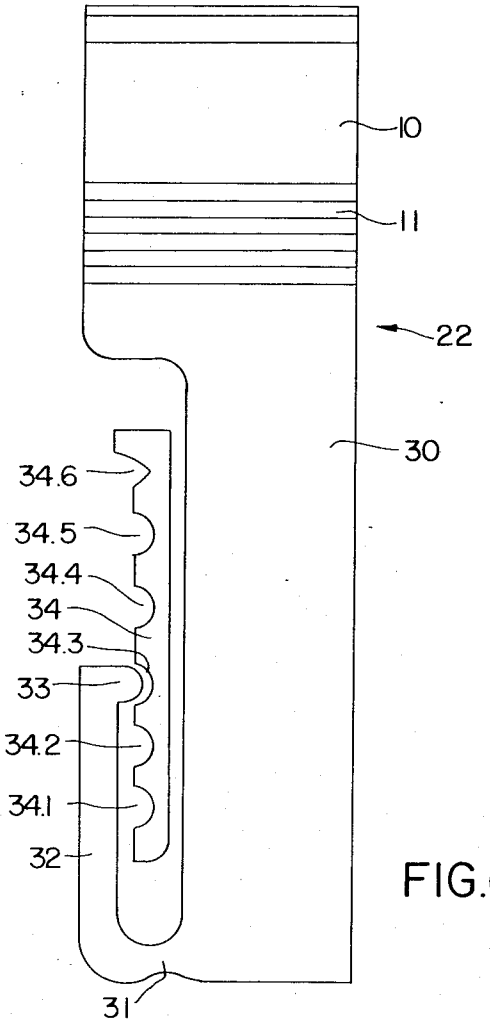
FIG. 6 is a view of the ratchet gear of the hair cutting apparatus of the invention for positioning the spacer comb at different distances relative to the forward edge of the shearing head.

FIG. 6 is a schematic front view of a vertically slidable grip member 30 comprising both the coupling rod 10 and the slide control 11 and serving as the central control of the hair cutting apparatus 1. Provided on the grip member 30 in this FIG. is a detent pawl 32 which is pivoted about a film hinge 31 formed thereon and has a tongue 33 which, due to its inherent resilience, engages into notches of a ratchet bar 34 formed fast with the casing of the hair cutting apparatus 1 to thereby provide a ratchet gear. The "zero" or "off" position of the slide control 11 is determined by engagement of the tongue 33 into the lowermost notch 34.1 (according to FIG. 6). If the slide control 11 is pushed upwards by one index position, the tongue 33 will engage the notch 34.2 which determines the "on" position of the slide control 11. The coupling rod 10, in leaving its "off" position it has assumed after overcoming the detent shoulder 18, will thus assume the "on" position in which its coupling nose 14 abuts the stop shoulder 24 and the outer wall 26 of the forced guide 27, thereby accomplishing the coupling of the hair cutting apparatus 1 with the spacer comb 3 for the purpose of positioning the spacer comb.

Pushing the slide control 11 in the direction x (FIG. 5) by another index position causes the tongue 33 to engage into the notch 34.3. As a result of the abutting engagement of its end wall 23 with the stop shoulder 24 of the coupling wall 16, the coupling rod 10 which is made to follow this movement in the direction x causes the spacer comb 3 to be shifted into its first ratchet position. In this first ratchet position, the hair extending through the spacer comb is cut to a relatively short length. In this embodiment, best seen in FIG. 2, the ratchet positions are indicated by a graduated scale 35 provided on the shearing head 2 of the hair cutting apparatus 1 and showing the digits "1" to "4" in a window 36 arranged between and below two adjacent tooth-shaped supports 8 of the spacer comb 3. A mark 37 provided on the front side of the spacer comb 3 indicates the respective ratchet position of the spacer comb 3—in the FIG. shown, the minimum possible ratchet position "1".

Similarly, a further upward shift of the coupling rod 10 by means of the slide control 11 it is operatively connected with moves the spacer comb 3 into further ratchet positions increasing the distance between the shearing head 2 and the spacer comb 3, these positions being identified by the tongue 33 falling into the respective notches 34.4, 34.5 and 34.6 and being indicated on the graduated scale 35 by the mark 37 corresponding with the scale digits "1", "2", "3" or "4", or by reading the lowermost scale digit not obstructed by the spacer comb, when viewed in the shifting direction.

Retracting the spacer comb 3—for example, to adjust the hair cutting apparatus to a shorter length of the cut—is accomplished simply by pushing the slide control 11 back in opposition to the direction of the arrow x. The coupling rod 10 will thus be moved in the same direction, and the action of the forced guide 27 will cause the coupling wall 16 of the spacer comb 3 to be entrained as a result of the abutting engagement of the beveled edge 38 of the rod with the corresponding beveled edge 39 of the coupling wall 16, until the ratchet position "1" is reached in which the hair is cut to the minimum length and which is identified by the tongue 33 falling into the notch 34.3. As the coupling rod 10 continues to be pushed back in opposition to the direction of the arrow x by means of the slide control 11, the coupling nose 14 of the rod 10, after having overcome the stop edge 40 which in FIG. 5 extends slightly below the plane of the stop shoulder 24 formed by the coupling wall 16, that is, protrudes relative to the latter by a small amount in the coupling direction x, reaches the area of the coupling groove 17 in which the coupling nose 14 of the coupling rod 10, abutting the detent shoulder 18 of the comb, is allowed to withdraw into the recess 20.

Accordingly, on further backward movement of the coupling rod 10 by means of the slide control 11, the coupling nose 14 will overcome the detent shoulder 18 by the rod 10 pivoting counterclockwise about the film hinge 15, thereby releasing the spacer comb 3 for removal by hand. The slide control 11 of the hair cutting apparatus thereby assumes the "on" position identified by the engagement of the tongue 33 into the notch 34.2, in which position the hair cutting apparatus is still enabled. Shifting the slide control 11 back still further until its detent pawl 32, 33 drops into the notch 34.1 finally disables the entire drive of the hair cutting apparatus 1 by means of the electric switch 21 controlled or actuated by the slide control 11.

FIGS. 7 to 10 show schematically the individual phases of engagement between the hair cutting apparatus 1 and the spacer comb 3 seated on its shearing head 2.

Figure 7:
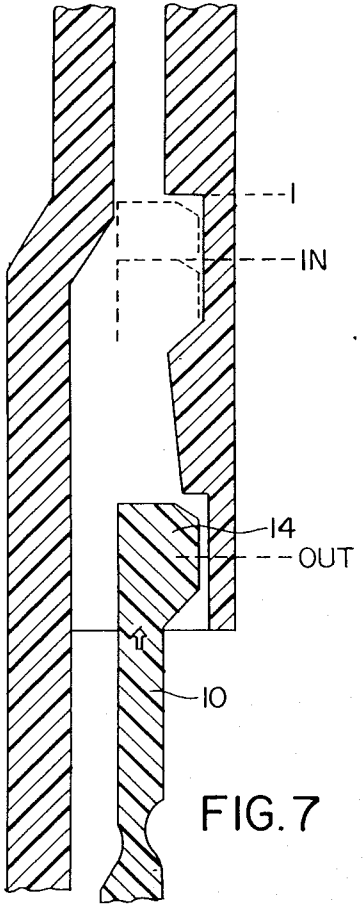

FIG. 7 shows the hair cutting apparatus 1 in its disabled position identified by "off". In this FIG., the control rod 10 is still below the spacer comb 3 loosely seated on the shearing head 2. It is not yet coupled with the latter.

Figure 8:
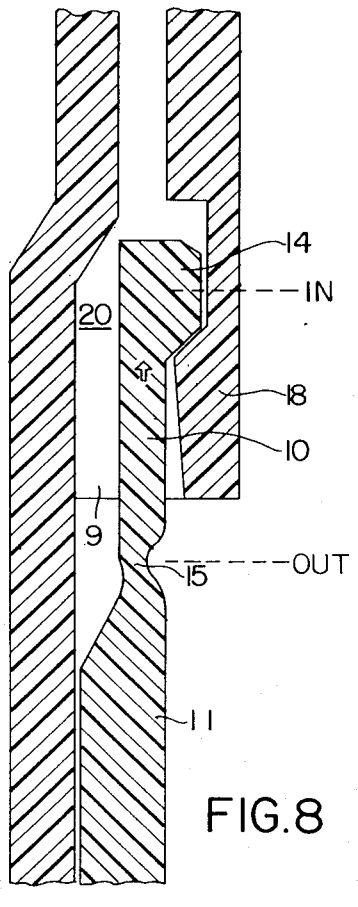

In FIG. 8, the coupling rod 10 is shown as shifted into its "on" position by means of the slide control 11, in which position the hair cutting apparatus 1 is operative without displacement of the seated spacer comb. In this position, the coupling nose 14 of the rod 10 which is pivoted by means of the film hinge 15 has overcome the detent shoulder 18 of the spacer comb 3 and secured the spacer comb 3 to the shearing head 2 of the hair cutting apparatus 1 to prevent it from unseating itself. In this coupled position, the spacer comb 3 may be lifted clear of the shearing head 2 at any time, which is accomplished by the coupling nose 14 of the rod 10 being urged back into the recess 20 of the guideway 9 of the hair cutting apparatus 1 by the detent shoulder 18 of the spacer comb 3.

Figure 9:
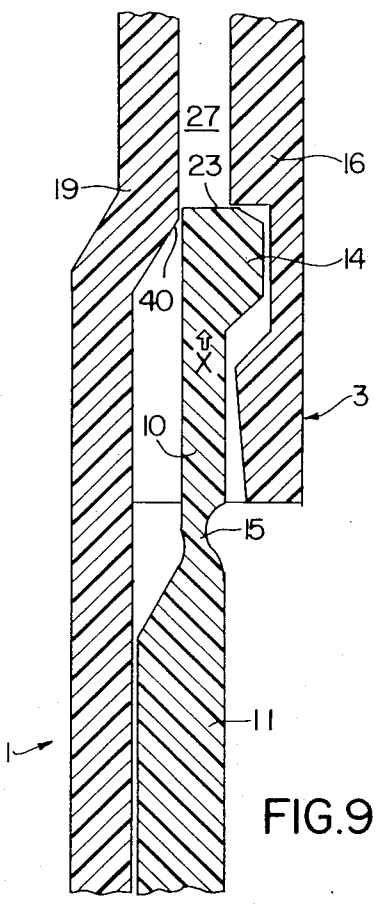

FIG. 9 shows the spacer comb 3 in its first locked coupling position on the shearing head 2 of the hair cutting apparatus 1, in which the spacer comb 3 is in the position "1" resulting in the shortest possible cut. In this position, the coupling nose 14 of the coupling rod 10, after having overcome the stop edge 40, is already in an area defined by the casing wall 19 of the hair cutting apparatus 1 on the one hand and by the coupling wall 16 of the spacer comb 3 on the other hand. As a result of this forced guide 27, the coupling rod 10 is not allowed to withdraw by pivoting about the axis of its film hinge 15, instead it is moved solely in the coupling direction x, that is, in or parallel to the longitudinal axis of the hair cutting apparatus 1 as the slide control 11 is notched. This enables the spacer comb 3 to be moved to further ratchet positions by means of the butt end 23 as described in the foregoing.

Figure 10:
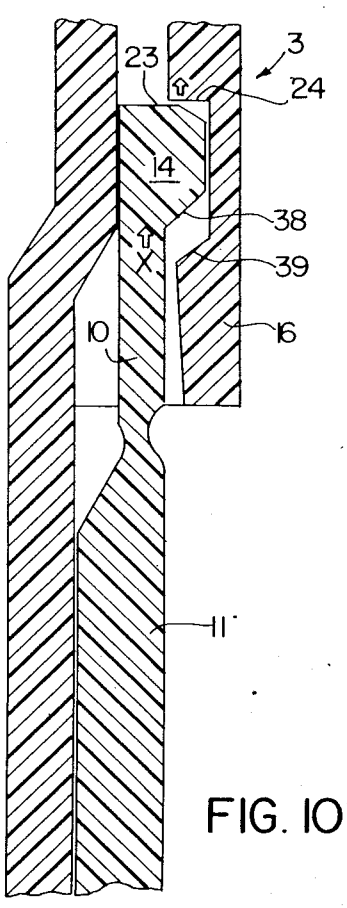
FIGS. 7 to 10 are functional schematics of the embodiment of the hair cutting apparatus of FIG. 5, showing its various phases of engagement.

FIG. 10 finally shows the spacer comb 3 shifted further upwards into one of its other ratchet positions increasing the length of the hair to be cut and identified by the digits "2", "3" or "4" on the graduated scale 35. In this FIG., the end wall 23 of the coupling rod 10 is in abutment with the stop shoulder 24 of the coupling wall 16.

According to FIG. 10, pushing the spacer comb 3 back occurs in the reverse direction, that is, by the slide control 11 moving the coupling rod 10 in its forced guideway back in opposition to the direction of the arrow x, with the abutting engagement of the beveled edge 38 of the coupling nose 14 with the beveled edge 39 of the coupling wall 16 of the comb causing the spacer comb 3 to be retracted into one of its lower ratchet positions. If the previous ratchet position was "4", this may be one of the ratchet positions "3", "2"or "1", for example. Only on returning the slide control 11 into its "on" or "off" position is the coupling rod 10 allowed to withdraw into the recess 20 formed by the guideway 9 and to release the spacer comb 3 seated on the shearing head 2 so that it can be lifted clear of the hair cutting apparatus 1.

Figure 11:
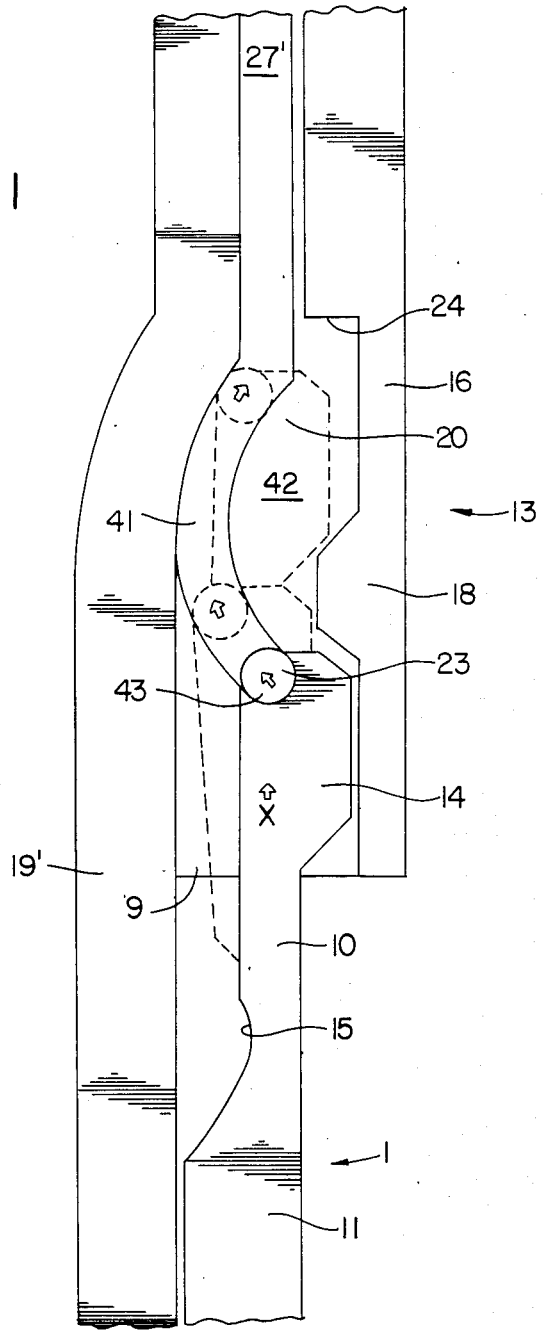
FIG. 11 is a schematic of an advantageous modification of the embodiment of the hair cutting apparatus of FIG. 5.

FIG. 11 shows a modification of the hair cutting apparatus of the invention in which the engagement means with the slip-on spacer comb is completed by an advantageous coupling structure 13 affording greater ease of operation.

The cooperation of the coupling members 10, 14 of the hair cutting apparatus 1 with the coupling means 16, 18 of the spacer comb 3 described in the foregoing becomes apparent from FIG. 11. In this embodiment, however, the casing wall 19' of the hair cutting apparatus 1 has on the side close to the coupling a coulisse 41 formed by a curved groove in a side wall 42 bounding the guideway 9 for the coupling rod 10 and lying adjacent to the casing wall 19'. Engaging into the coulisse 41 is a guide pin 43 formed at the coupling rod 10, which may also be a guide roller fitted to such a pin. As the coupling rod 10 is shifted upwards by the slide control 11 of the hair cutting apparatus being switched from its "off" to its "on" position, the guide pin 43 cooperates with the coulisse 41 in the sense of facilitating the movement of the rod 10 into its coupled position in which it is retained behind the detent shoulder 18 of the coupling wall 16 of the comb, thereby securely clamping the spacer comb 3 in its merely slipped-on position on the shearing head 2.

As becomes apparent, the coulisse 41 provides for lifting of the coupling rod 10 together with its coupling nose 14 formed thereat over the detent shoulder 18 of the coupling wall 16 of the comb (first position shown in broken lines), subsequently moving it into its "on" position behind the detent shoulder 18 (second position shown in broken lines), whereupon the rod 10 enters the region of the forced guide 27' in which the coupling rod 10—with its butt end 23 hitting against the stop shoulder 24 of the coupling wall 16 of the comb —moves the spacer comb 3 into its respective ratchet positions resulting in longer lengths of the hair to be cut.

Providing the coupling rod 10 with the guide pin 43 engaging into the coulisse 41 makes it possible to design also the forced guide 27 as a continuation of the coulisse 41, that is, unlike the embodiments of FIGS. 5 to 10, to form this forced guide from the casing wall 19 of the hair cutting apparatus 1 and from the coupling wall 16 of the spacer comb 3. A coulisse 41 of this type which also includes the forced guide 27' ensures a particularly secure and wear-resistant guide, insusceptible to jamming, for the coupling rod 10 of the slide control 11 of the hair cutting apparatus 1, with the rod being merely pivoted about the film hinge 15 and guided in a straight line.

For pre-centering the spacer comb 3 seated on the shearing head 2 of the hair cutting apparatus 1, detent cams 44 may be provided on the inner sides of the two parallel side walls of the spacer comb, for cooperation with appropriate recesses 45 provided in the outer sides of the corresponding outer walls of the shearing head of the body 7 of the hair cutting apparatus 1.

Figure 14:
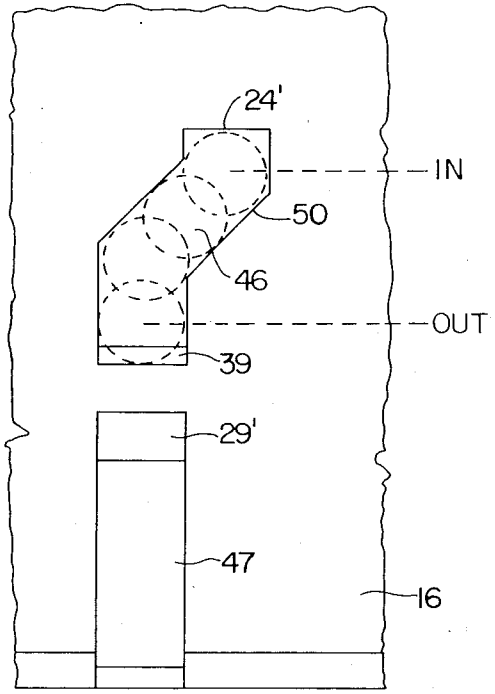
FIGS. 12 to 14 are views of an embodiment having an additional laterally displaced forced guide.
Figure 13:
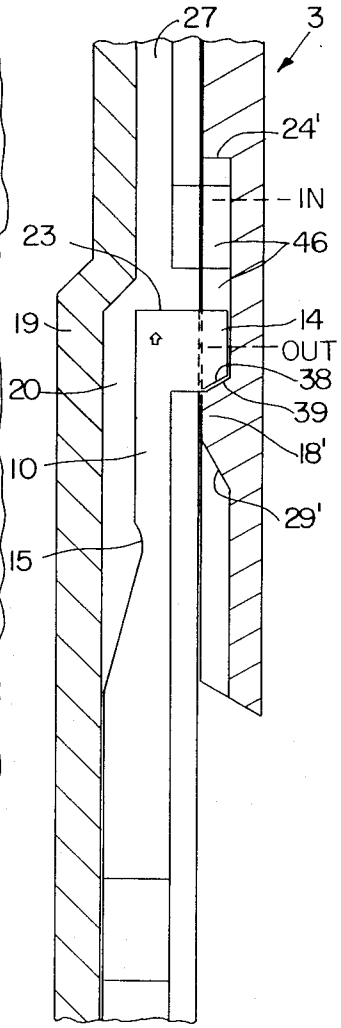
Figure 12:
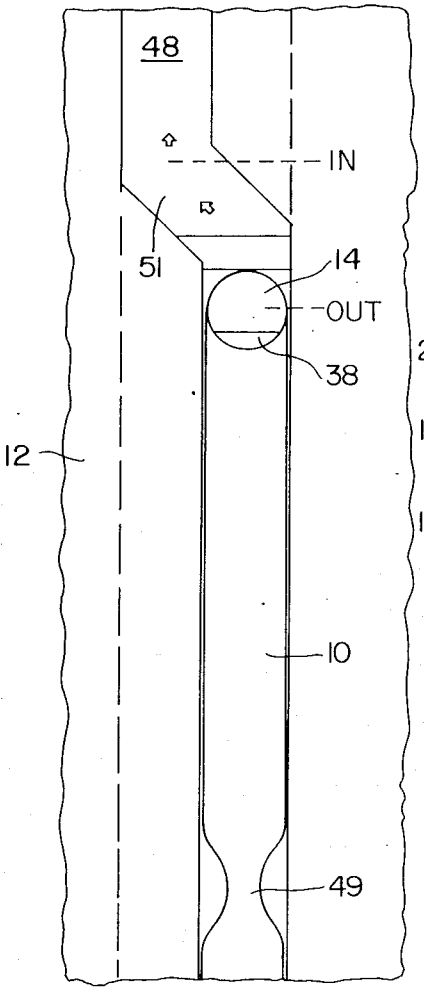

FIGS. 12 to 14 show a further embodiment of the hair cutting apparatus and the spacer comb. In this embodiment, FIG. 12 shows a detail of the front view of the hair cutting apparatus with the spacer comb removed, FIG. 13 shows the coupling between the hair cutting apparatus and the seated spacer comb in a sectional side view (according to FIG. 5), and FIG. 14 shows a detail of the coupling wall of the spacer comb as viewed from the inside. As becomes apparent from this embodiment, the spacer comb 3 is retained by the coupling nose 14 of the coupling rod 10 already in the "off" position and thus securely clamped in place. In the embodiments so far described, this effect is not accomplished until the hair cutter is in the "on" position.

As the spacer comb 3 is slipped on the shearing head of the hair cutting apparatus, the coupling nose 14 of the coupling rod 10 slides in the slip-on groove 47 of the coupling wall 16 of the spacer comb. At the beveled edge 29' of the detent shoulder 18' of the spacer comb, the coupling rod 10 is urged into the recess 20 of the casing wall 19 by pivoting about the film hinge 15. After having thus overcome the detent shoulder 18', the coupling rod 10 pivots back into the position shown in FIG. 13. While this position corresponds to the position shown in FIG. 5, FIG. 13 shows the slide control 11 still in its "off" position whereas it is already in its "on" position in FIG. 5, so that in FIG. 13 the spacer comb is resiliently retained already in the "off" position. In this embodiment, too, pulling the comb off the shearing head in this position is accomplished by cooperation of the beveled edge 38 on the coupling nose 14 of the coupling rod 10 with the beveled edge 39 on the detent shoulder 18' of the spacer comb.

When the hair cutting apparatus with the spacer comb seated thereon is switched on by means of the slide control 11, the coupling nose 14 of the coupling rod 10 is guided not only in upward direction, but also in a laterally displaced direction (FIG. 12). This guiding of the coupling nose 14 in a leftward upwardly inclined direction is accomplished by means of a coulisse 51 provided in the front wall 12 of the hair cutting apparatus. Coulisse 51 in the front wall 12 is congruent with the coupling coulisse 46 in the coupling wall 16 of the spacer comb (FIG. 14), so that the spacer comb does not engage the coupling nose 14 when the coupling rod 10 is guided from the "off" into the "on" position (and vice versa).

In this "on" position, the apparatus is enabled and the spacer comb can no longer be slipped off, because the ooupling rod 10 is already in the forced guide 27 preventing the coupling rod 10 from withdrawing backwards as described with reference to the other embodiments. Lateral withdrawal of the coupling rod 10 is not possible either in this position when an attempt is made to remove the spacer comb, because its coupling nose 14 is retained in the coulisse 51 of the front wall, abutting the stop edge 50 of the coupling coulisse 46 in the coupling wall 16 of the spacer comb.

If the slide control 11 is shifted upwards into its further ratchet positions to increase the length of the cut, the lateral guide of the coupling nose 14 is accomplished in a forced guide 48 which is displaced in parallel to the longitudinal axis x of the hair cutting apparatus. The end wall 23 of the coupling rod 10 thus abuts the stop shoulder 24' of the coupling coulisse 46 of the spacer comb, shifting it upwardly as described above.

Pushing the control back involves a movement in the reverse order. Until the "on" position, the coupling rod 10 will entrain the spacer comb, because the coupling nose 14 is in abutment with the stop edge 50 of the coupling coulisse 46 of the spacer comb, and the coupling rod is prevented from withdrawing either laterally due to the forced guide 48 or backwards due to the forced guide 27. Only in the "off" position can the coupling rod 10 withdraw backwards again to thus allow the removal of the spacer comb.

Figure 17:
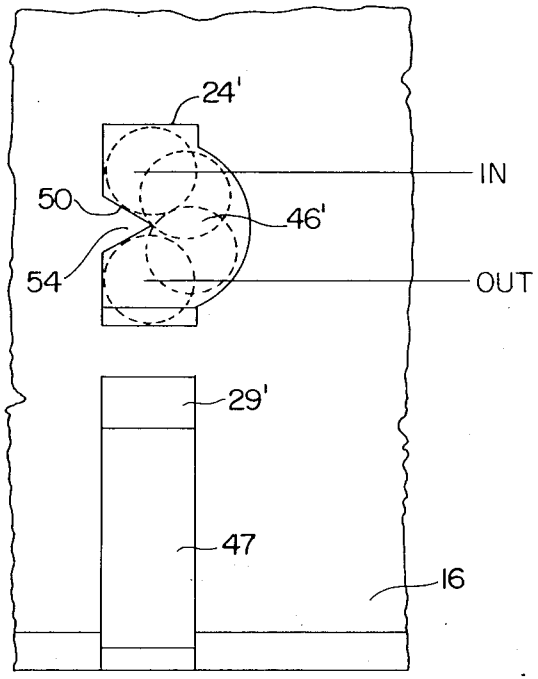
FIGS. 15 to 17 are views of an embodiment having an additional lateral forced deflection structure.
Figure 16:
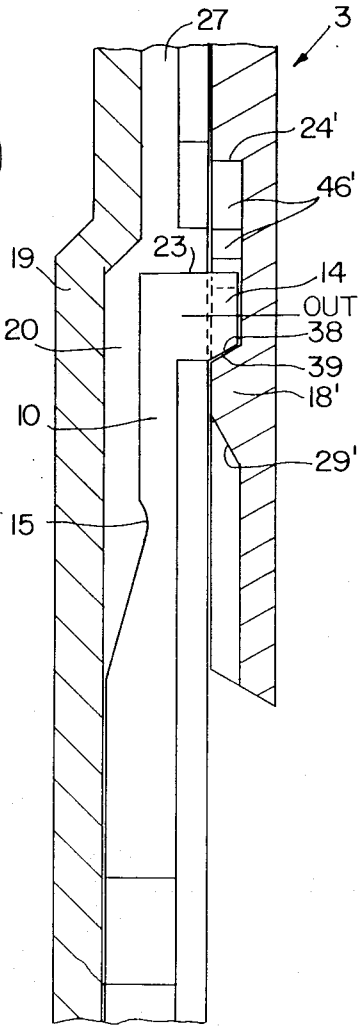
Figure 15:
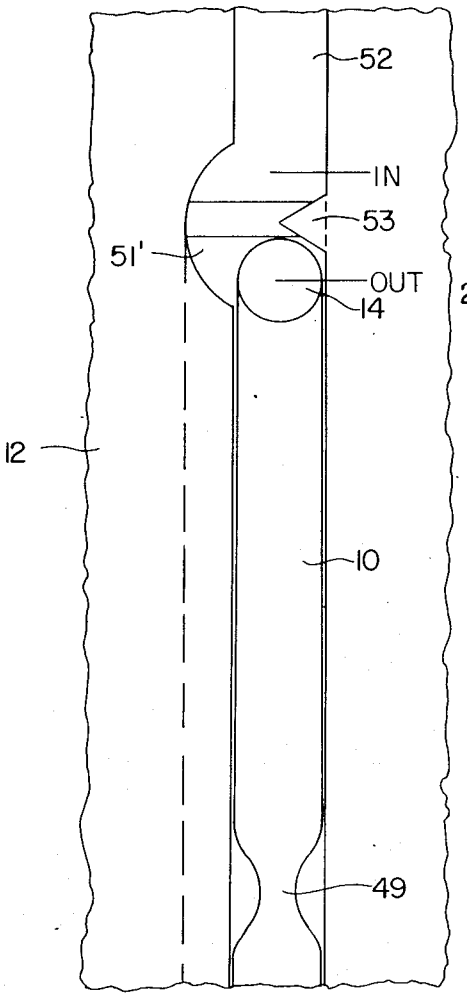

Another advantageous embodiment of the coupling means is shown in FIGS. 15 to 17. The views of FIGS. 15, 16 and 17 correspond to those of FIGS. 12, 13 and 14, respectively. In this embodiment, too, the spacer comb is retained already in the "off" position. As the spacer comb is slipped on the shearing head, the coupling means cooperate by analogy with the description with reference to FIGS. 12 to 14. This embodiment differs in the construction of the coulisse 51' in the front wall 12 (FIG. 15) and the congruent coupling coulisse 46' of the coupling wall 16 (FIG. 17). Both are shaped in the manner of a circular sector.

In moving from the "off" to the "on" position, the coupling nose 14 of the coupling rod 10 is laterally guided in the coulisse 51' (FIG. 15) around the cam 53 along the line of an arc, so that in the "on" position the coupling rod lies again in the longitudinal axis x of the hair cutting apparatus.

Shifting the control into the next ratchet positions urges the coupling nose 14 laterally into a forced guide 52 whose longitudinal axis is identical with the longitudinal axis x of the apparatus or the longitudinal axis of the coupling rod 10. As a result, by contrast with the embodiment of FIGS. 12 to 14, the coupling rod 10 is not loaded by the film hinge 49 in all ratchet positions. When the control is shifted back from higher to lower ratchet positions (down to the "on" position), the lower edge of the coupling nose 14 abuts the stop edge 50' of the coupling coulisse 46' or the stop nose 54 of the spacer comb. Otherwise the mode of operation of this embodiment is the same as the one of FIGS. 12 to 14.

While embodiments and applications of this invention have been shown and described, it will be apparent that many more modifications are possible without departing from the inventive concepts herein desribed. The invention, therefore, is not to be restricted except as is necessary by the prior art and by the spirit of the appended claims.

What is claimed as new and desired to be secured by Letters Patent of the United States is:

1. A powered hair-cutting apparatus comprising:

A powered hair-cutting apparatus comprising:

a housing including a casing wall having a stop edge means;

a shearing head having a shear plate and a cooperating cutting element including a forward cutting edge, fixedly mounted on said housing;

a spacer comb having a coupling wall including a detent shoulder and a stop shoulder, displaceably seated on said shearing head for sliding contact with the skin surface; and a slide control means including a slide control member and a coupling rod, said coupling rod having a coupling nose including an end wall movably located between said casing wall of said housing and said coupling wall of said spacer comb, said slide control member being coupled to said coupling rod and controlling the displacement of said coupling rod between said casing wall and said coupling wall, said slide control member providing a first position in which said cutting element of the powered hair-cutting apparatus receives no driving force;

said slide control member providing a second position in which said cutting element of the powered hair cutting apparatus receives a driving force, and said coupling nose of said coupling rod is positioned between said detent shoulder and said stop shoulder of said coupling wall;

said slide control member provides a third position in which said coupling nose is arrested by said stop edge means of said casing wall; and said slide control member providing a fourth position in which said coupling nose is arrested by said stop edge means of said casing wall and said end wall of said coupling nose abuts said stop shoulder of said coupling wall thereby causing said coupling wall of said spacer comb to be displaced with respect to said cutting element of said shearing head.

2. The hair cutting apparatus as in claim 1 wherein said coupling rod is a resiliently yielding coupling rod.

3. The hair cutting apparatus as in claim 2 wherein said resiliently yielding coupling rod includes a film hinge.

4. The hair cutting apparatus as in claim 3 which said coupling nose of said coupling rod includes a first and second beveled edge and said detent shoulder of said coupling wall includes a first and second beveled edge, wherein as a result of the pivoted withdrawal of said coupling rod by means of said film hinge formed thereon, said first and second beveled edges of said coupling nose cooperate with said first and second beveled edges of said detent shoulder when said coupling rod is moved from said first to said second positions.

5. the hair cutting apparatus as in claim 1 wherein said slide control means includes a ratchet bar and said slide control member includes a detent pawl, said detent pawl resiliently engaging said ratchet bar to establish said first, second, third, and fourth positions.

6. The hair cutting apparatus as in claim 5 wherein said slide control member, said coupling rod, and said detent pawl are integrally formed.

7. The hair cutting apparatus as in claim 6 wherein said detent pawl is connected to said slide control member through a film hinge.

8. The hair cutting apparatus as in claim 5 further including a visual position indicator indicating the position of said detent pawl in said ratchet bar, said spacer comb including a plurality of tooth-shaped supports, said visual position indicator being visible betewen and below two adjacent said tooth-shaped supports of said spacer comb.

9. The hair cutting apparatus as in claim 1 further including a first coulisse provided in said casing wall of said housing and further including a guide pin arranged at said coupling nose of said coupling rod.

10. The hair cutting apparatus as in claim 1 including a second coulisse provided in said casing wall of said housing for laterally guiding said coupling nose of said coupling rod, and further including a third coulisse provided in said coupling wall of said spacer comb, said second coulisse being congruent with said third coulisse.

11. The hair cutting apparatus as in claim 1 wherein said spacer comb is resiliently held on said shearing head in said first position and secured to said shearing head in all other positions.

12. The hair cutting apparatus as in claim 1 further including a film hinge formed between said slide control member and said coupling rod to allow the lateral displacement of said coupling nose.

13. The hair cutting apparatus as in claim 10 wherein said second coulisse guides said coupling nose in an upwardly inclined direction when said slide control member is moved from said first to said second position, while sliding in all other positions in a laterally acting force guide having a longitudinal axis extending parallel to a longitudinal axis of said coupling rod, when said coupling rod is in said first position.

14. The hair cutting apparatus as in claim 10 wherein said second coulisse is shaped as a circular sector and said detent shoulder of said coupling wall of said spacer comb is cam shaped.

* * * * *